United States Patent [19]

Dose

[11] 4,343,464

[45] Aug. 10, 1982

[54] PLAYGROUND SLIDE AND SHELTER

[76] Inventor: Curtis R. Dose, 2559 San Anselmo, San Diego, Calif. 92109

[21] Appl. No.: 138,114

[22] Filed: Apr. 7, 1980

[51] Int. Cl.[3] ..... A63B 21/00

[52] U.S. Cl. ..... 272/56.5 R; 4/494; 190/1; 272/1 A

[58] Field of Search ..... 272/56.5 R, 56.5 SS, 272/1 R, 1 A, 113; D21/242, 243, 244, 252; 46/17; 4/494, 488, 498; 190/1, 10, 11, 8, 12 R; 38/112, 103, 104; 182/29, 20, 28; 9/2 R, 2 F

[56] References Cited

U.S. PATENT DOCUMENTS

| | | | |
|---|---|---|---|
| D. 257,054 | 9/1980 | Ferretti | D21/252 |
| D. 257,055 | 9/1980 | Ferretti | D21/252 |
| 327,749 | 10/1885 | Wulff | 190/11 X |
| 1,349,687 | 8/1920 | Mitchell | 190/12 R |
| 1,357,465 | 11/1920 | Mayer | 272/56.5 R |
| 1,526,680 | 2/1925 | Rees | 272/56.5 R |
| 1,961,957 | 6/1934 | Bock | 46/17 X |
| 2,168,392 | 8/1939 | Birch | 272/1 A X |
| 2,396,341 | 3/1946 | Perry | 272/56.5 R |
| 2,820,635 | 1/1958 | Herman | 272/1 A |
| 2,848,229 | 8/1958 | Miller | 272/1 A |
| 3,049,825 | 8/1962 | Boyd | 190/11 X |
| 3,114,544 | 12/1963 | Jaensch et al. | 272/56.5 R |
| 3,263,994 | 8/1966 | Londgren | 272/56.5 R |

FOREIGN PATENT DOCUMENTS

| | | | |
|---|---|---|---|
| 381640 | 10/1932 | United Kingdom | 272/56.5 R |

*Primary Examiner*—Richard J. Apley
*Assistant Examiner*—Arnold W. Kramer
*Attorney, Agent, or Firm*—Brown & Martin

[57] ABSTRACT

A playground structure includes a container for containing a playing medium with a substantially rigid cover having a slide thereon with the cover hinged to the container and including a plurality of further hinged panels for alternately folded covering of the container and unfolding into a playground shelter and slide. Ladders at the end of the slide and alongside the slide for providing access to the slide from ground level and from the container.

7 Claims, 4 Drawing Figures

PLAYGROUND SLIDE AND SHELTER

BACKGROUND OF THE INVENTION

The present invention relates to playground structures and pertains particularly to a multiple function playground structure.

Certain public and backyard playground structures require covering during certain periods of time and especially when not attended by an adult. Such structures as sandboxes and the like require covering when not attended by children and the like, to prevent use thereof by dogs, cats and other animals as repository for waste and the like. Many animals such as dogs and particuarlly cats, utilize sandboxes and the like when available for their toilet facility. Such use by animals contaminate the play area and not only render it undesirable for use, but can create a health hazard.

Other playground structures such as swimming and wading pools can be hazardous when not attended by an adult. Such structures require durable covering or fencing to prevent access thereto by children when adults are not in attendance.

While a separable cover would in most instances solve the above problem, it is also desirable that maximum use be made of the playground space and area.

It is therefore desirable that some means be available that eliminate the hazard and problems of the above described open containers and yet provide maximum use of the playground space and area.

SUMMARY OF THE INVENTION

It is therefore the primary object of the present invention to overcome the above problems of the prior art.

Another object of the present invention is to provide an improved cover for playground containers and the like.

A further object of the present invention is to provide a multiple use playground structure.

In accordance with the primary aspect of the present invention a playground container such as a sandbox or wading pool is provided with a cover panel pivotally connected to the container and including further panels hingedly connected thereto for opening into a combined adjacent play shelter, and slide for the container.

BRIEF DESCRIPTION OF THE DRAWINGS

The above and other objects and advantages of the present invention will become apparent in the following description when read in conjunction to the drawings wherein.

DETAILED DESCRIPTION OF THE PREFERRED EMBODIMENT

Figure 1:
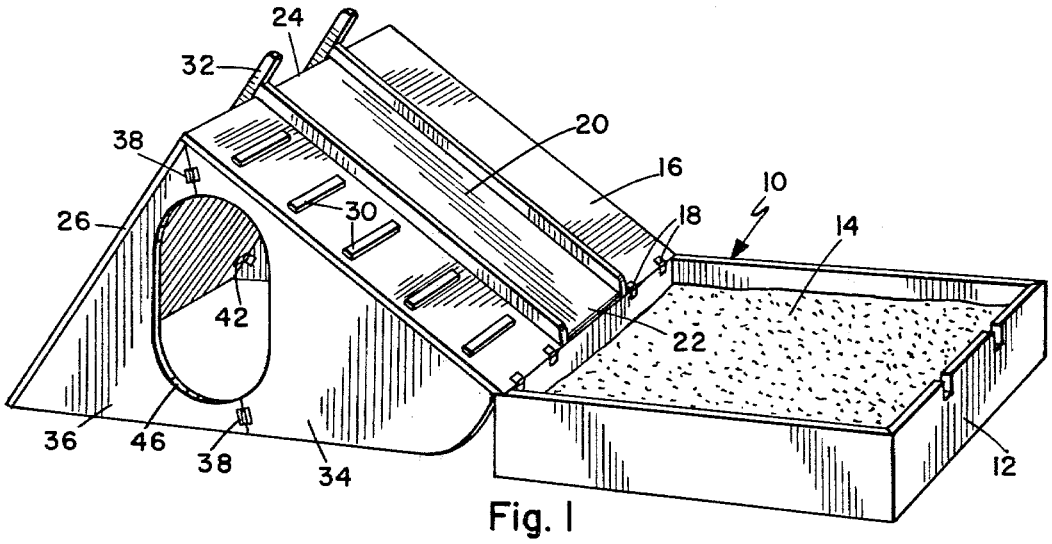
FIG. 1 is a perspective view of the preferred embodiment of the invention in the open position.

Turning to the drawings, shown in FIG. 1 is a perspective view of a multiple use playground structure in accordance with the preferred embodiment of the invention and designated generally by the numeral 10. This structure includes as a primary feature thereof, a generally rectangular container 12 having a depth as desired, which may be on the order of from two to four feet. Within the container is a playing medium 14 which may be either sand or water. Should the playing medium be sand or the like, the container 12 can simply be constructed of planks of wood or the like, and may have a fairly shallow depth.

Should the playing medium be water, the container of course must be of a suitable structure to support the necessary depty of water, and so constructed to avoid leakage. The necessary filtering equipment would also be provided, which for the purposes of simplicity are not shown herein. The depth of the container as discussed, can be selected to suit the application as well as the medium to be placed therein.

As previously pointed out in either of the above cases, it is desirable that the container 12 be covered during certain periods of time to avoid contamination of the playing medium, should it be sand or the like, or to prevent access thereto by children unaccompanied by adults, should the playing medium be water. For this reason a cover panel 16 having a general size and configuration to completely cover the container is pivotally connected by means of suitable hinges 18 along the edge of one side or end of container 12. The cover panel 16 is preferably of a durable rigid material such as plywood or some other suitable similar building material. Mounted on the panel 16 which is in what would oridinarily be the inside face, is an elongated slide 20 having an inner end at 22 opening into the container 12 and an outer end 24 positioned distally from the container 12. This slide is supported on the panel 16 which in turn is supported by a support panel 26 which supports the outer end of the panel slide in an elevated position.

Access to the upper end of the slide is provided by a first ladder defined by a plurality of rungs 30 attached to the surface of panel 16 beside the slide 20. This ladder 30 provides access to the upper end 24 of the slide 20 from the container 12. A second ladder 32 (see FIG. 2) provides access to the outer end 24 of slide 20 from ground level. This ladder 32 may be preferably secured to an extend along the surface of the panel 26.

The area beneath the cover panel 16 and the end or the top panel 26 is enclosed by means of a pair of panels 34 and 36 which are hinged together along a diagonal line by hinges 38 and hinged respectively to the cover panel 16 by hinges 40 and to panel 26, by means of hinges 42. Similar panels hinged along a similar angular line enclose the other side of the cover or enclosed cover area, as in FIG. 2.

Figure 2:
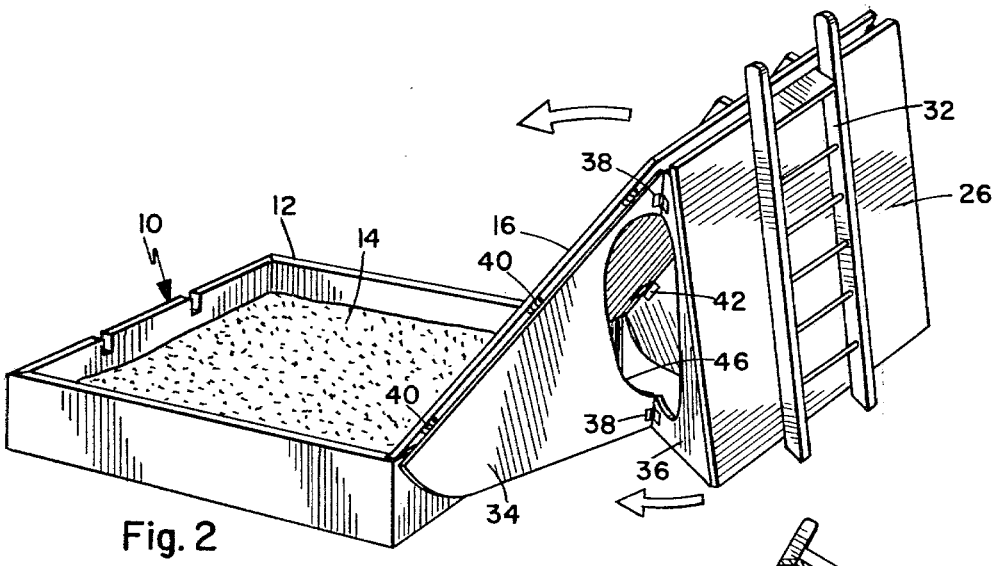
FIG. 2 is a perspective view showing the closing action of the structure.
Figure 3:
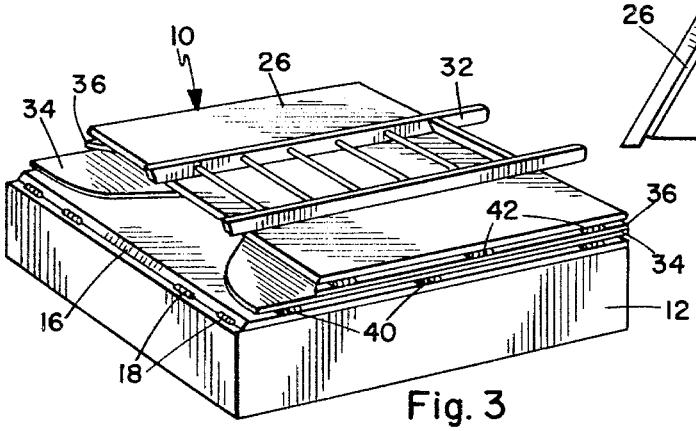
FIG. 3 is a perspective view of the structure in the closed position.
Figure 4:
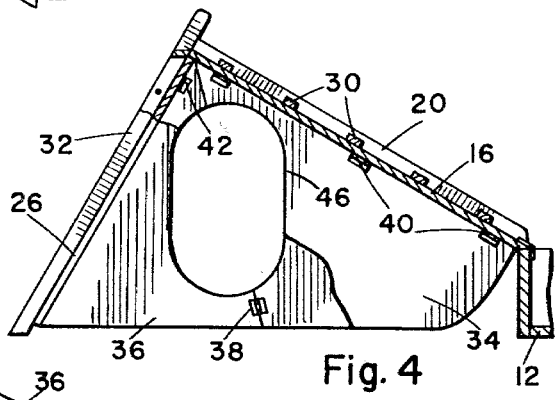
FIG. 4 is a side elevational view of the open structure with portions cut away.

The panels 34 and 36 are cut and hinged together along a line to fold into a folded position to lie on top of panel 16 when panel 16 is in the closed or covered position and to fold beneath the panel 26, as in FIG. 2. In the closed position shown in FIG. 4, the folded side panels 34 and 36 lie between the cover panel 16 and support panel 26. An opening or door 46 is provided in the combined side panels 36 and 34 to provide access to the enclosed shelter beneath the cover 16.

The above described playground structure thus provides a combination of a playing medium container having a cover to prevent access to the medium within the container when desired. Further associated with the playing container is a slide which is mounted on the cover with the cover then providing additional function of supporting the slide with access by means of a ladder up the cover panel to the upper end of the slide that children can climb into the slide and slide into the container and the playing medium therein.

Further associated with the cover panel is a plurality of side panels and an end panel that provides an enclosed playing structure when the cover structure is in the uncovered position as shown in FIGS. 1–4. This provides a multiple unit playground structure which provides cooperating playing devices interrelated to cooperate thereby providing interrelating functions and similarly provides a multiple use structure taking up very little or minimal playground area.

From the above description it can be seen that I have provided a multiple use, multi-functional playground structure suitable for backyard, as well as public playground use. These structures provide a multiple function interrelated playground structure wherein each component therein provides multiple interrelated and cooperative functions.

While I have illustrated and described by invention by means of specific embodiments, it is to be understood that numerous changes and modifications may be made therein without departing from the spirit and scope of the invention as defined in the appended claims.

I claim:

1. A playground structure, said structure comprising:

an open top container for containing a playing medium;

a substantially rigid cover panel having an inner edge and an outer edge and connected at said inner edge to said container for pivoting to a first position for covering said container and to a second position for opening said container for exposing the playing medium;

an elongated slide mounted on the inside of said cover panel and having an inner end at said inner edge and an outer end at said outer edge remote from said inner edge; and support means pivotally connected to said cover panel at said outer edge for supporting said cover panel and said slide in an inclined position inclined toward said container for enabling sliding into said container when said cover is in said second position.

2. The playground structure of claim 1 including a plurality of panels side panels for each side of the structure, the panels on each side being pivotally connected to said cover panel and said support means and each other has been for cooperating therewith for defining an enclosed shelter when said cover panel is pivoted to said second position.

3. The playground structure of claim 2 wherein said plurality of side panels are foldable onto said cover panel and below said support means when said cover panel is pivoted to the closed position.

4. The playground structure of claim 1 including ladder means secured to one of said cover panel and said support means for providing access to the outer end of said slide.

5. The playground structure of claim 4 wherein said ladder means comprises a ladder mounted on said cover panel and extending along said slide for providing access to the outer end of said slide from said container.

6. The playground structure of claim 4 wherein said ladder means includes a ladder mounted on said support means and providing access to the outer end of said slide from the ground level.

7. The playground structure of claim 1, said support means comprising a top panel for supporting said cover panel in said second position.

* * * * *

UNITED STATES PATENT AND TRADEMARK OFFICE

CERTIFICATE OF CORRECTION

PATENT NO. : 4,343,464

DATED : August 10, 1982

INVENTOR(S) : Curtis R. Dose

It is certified that error appears in the above—identified patent and that said Letters Patent is hereby corrected as shown below:

Column 4, Claim 2, line 10, after the word "of" delete -- panels --.

Column 4, Claim 2, line 13, after the word "other" delete -- has been --.

Signed and Sealed this

Ninth Day of November 1982

[SEAL]

Attest:

GERALD J. MOSSINGHOFF

Attesting Officer

Commissioner of Patents and Trademarks